US010948853B2

(12) United States Patent
Cohen et al.

(10) Patent No.: US 10,948,853 B2
(45) Date of Patent: Mar. 16, 2021

(54) LIQUID ELECTRO-PHOTOGRAPHIC PRINTING TRANSFER DEVICES

(71) Applicant: HP INDIGO B.V., Amstelveen (NL)

(72) Inventors: Lavi Cohen, Ness Ziona (IL); Doron Schlumm, Ness Ziona (IL); Asaf Shoshani, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/487,743

(22) PCT Filed: Mar. 31, 2017

(86) PCT No.: PCT/EP2017/057716

§ 371 (c)(1),
(2) Date: Aug. 21, 2019

(87) PCT Pub. No.: WO2018/177539

PCT Pub. Date: Oct. 4, 2018

(65) Prior Publication Data

US 2020/0233339 A1 Jul. 23, 2020

(51) Int. Cl.
*G03G 15/10* (2006.01)
*G03G 15/02* (2006.01)

(52) U.S. Cl.
CPC ..... *G03G 15/105* (2013.01); *G03G 15/0216* (2013.01); *G03G 15/0266* (2013.01)

(58) Field of Classification Search
CPC ..... G03G 15/10; G03G 15/104; G03G 15/105
USPC ..... 399/237, 238, 239, 249
See application file for complete search history.

(56) References Cited

U.S. PATENT DOCUMENTS

| | | | |
|---|---|---|---|
| 7,995,953 | B2 | 8/2011 | Ozerov |
| 9,244,389 | B2 | 1/2016 | Sandler et al. |
| 9,291,927 | B2 | 3/2016 | Sandler et al. |
| 2006/0251449 | A1 | 11/2006 | Takahashi et al. |
| 2008/0304846 | A1 | 12/2008 | Tombs et al. |
| 2009/0279911 | A1 | 11/2009 | Raz |
| 2013/0038667 | A1 | 2/2013 | Bachar |

FOREIGN PATENT DOCUMENTS

| | | |
|---|---|---|
| JP | S57111568 | 7/1982 |
| WO | WO-2013107880 A1 | 7/2013 |

OTHER PUBLICATIONS

Xerox, "Solid Ink", Available at: < https://www.xerox.co.uk/office/solid-ink/engb.html#_overview >.

*Primary Examiner* — Benjamin R Schmitt
(74) *Attorney, Agent, or Firm* — Dierker & Kavanaugh PC

(57) ABSTRACT

In an example, charged particles suspended in a non-conductive fluid are fed to a transfer device. A width of a charged particles layer of uniform density on a surface of the transfer device is controlled. Charged particles are transferred from the charged particles layer to a photo imaging plate of a liquid electro-photographic printing system.

7 Claims, 7 Drawing Sheets

LIQUID ELECTRO-PHOTOGRAPHIC PRINTING TRANSFER DEVICES

BACKGROUND

Liquid electro-photographic (LEP) printing, sometimes also referred to as liquid electrostatic printing, uses liquid toner to form images on paper, foil, or another print medium. The liquid toner, which is also referred to as ink, includes particles dispersed in a carrier liquid. The particles have a color which corresponds to the process colors that are to be printed in accordance with a used color model such as, for example, CMYK.

BRIEF DESCRIPTION OF THE DRAWINGS

The following examples will become more readily appreciated in conjunction with the accompanying drawings, in which like reference numerals refer to like parts throughout the various views, unless otherwise specified.

DETAILED DESCRIPTION

A LEP printing process may involve selectively charging/discharging a photoconductor, also referred to as photo imaging plate, PIP, to produce a latent electrostatic image. For example, the PIP may be uniformly charged and selectively exposed to light to dissipate the charge accumulated on the exposed areas of the photoconductor. The resulting latent image on the photoconductor may then be developed by applying a thin layer of charged toner particles to the photoconductor.

The charged toner particles may adhere to negatively charged or discharged areas on the photoconductor (discharged area development DAD) or to positively charged areas on the photoconductor (charged area development CAD), depending on the charge of the toner particles and the charge accumulated on the PIP surface. The image on the PIP formed by the charged toner particles adhering to the PIP may then be transferred to a charged and heated intermediate transfer member, ITM, which transfers the print medium.

Figure 1:
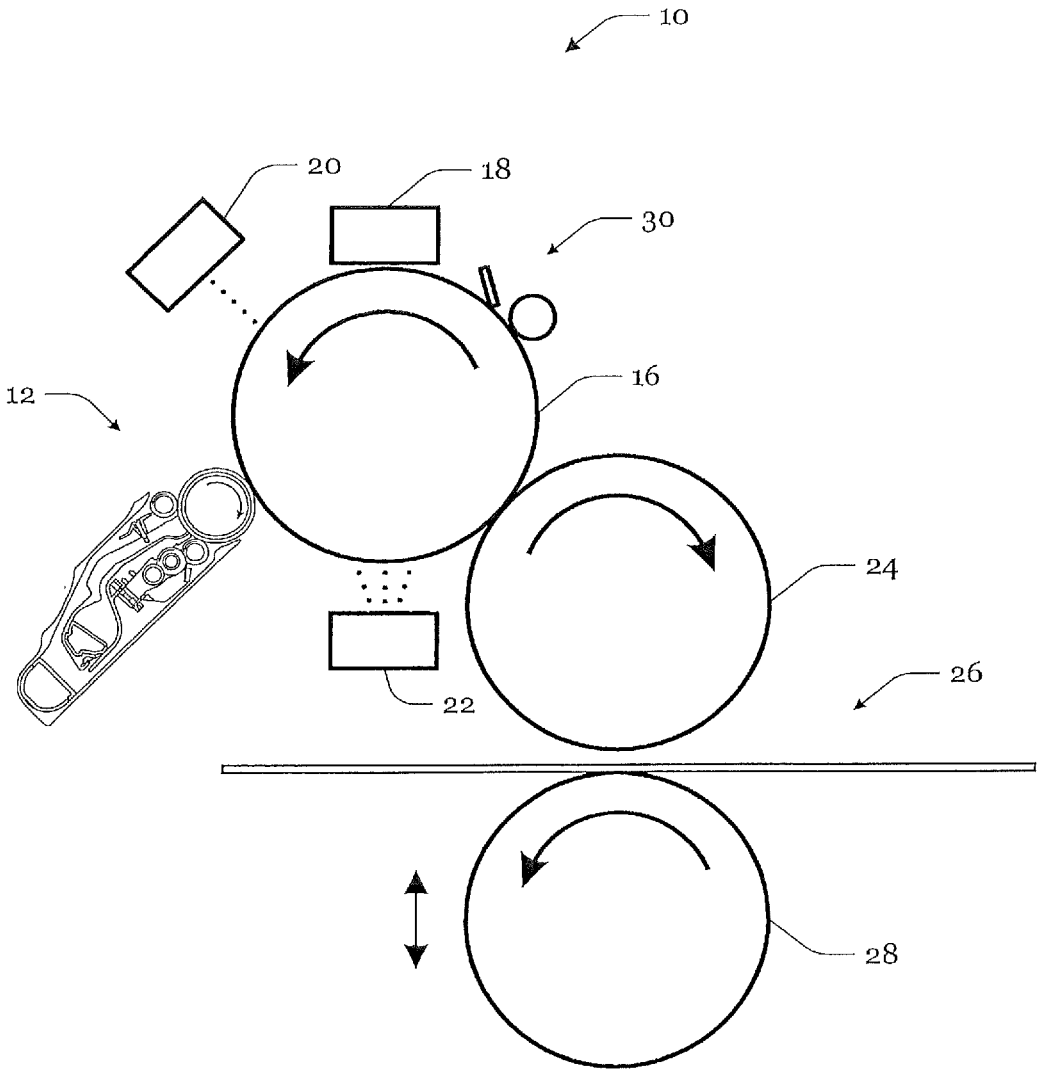
FIG. 1 is a schematic cross-sectional view of an LEP printing system, according to an example.

FIG. 1 is a schematic cross-sectional view of an LEP printing system 10, according to an example. The system 10 comprises a BID assembly 12 which, during operation, may feed charged particles suspended in a non-conductive carrier fluid, e.g., an imaging oil, from an ink inlet 14 to the PIP 16. The carrier fluid may be a fluid in which polymers, particles, colorant, charge directors and other additives can be dispersed to form a liquid electrostatic ink or electrophotographic ink. As shown in FIG. 1, the PIP 16 may comprise a thin film of photoconductive material wrapped around the cylindrical surface of a rotating drum. In another example, a photoconductive film may be provided on a belt or platen which is movable relative to the BID assembly 12. During operation, a uniform electrostatic charge may be applied to an area on the surface of the photoconductive material passing by a charging station 18. The charging station 18 may heretofore comprise, for example, a scorotron, a charge roller, or another charging device.

To provide for selectively charged surface areas, the uniformly charged area may pass by a selective discharging station 20. The selective discharging station 20 may selectively expose the surface of the photoconductive material to light, for example. As a result, the charge on the exposed areas may dissipate, thereby providing for discharged areas. For instance, the surface of the photoconductive material may be selectively discharged by a laser or another suitable photo imaging device. Hence, the surface of the photoconductive material passing by the selective discharging station 20 may be divided into charged and discharged areas, wherein a voltage differential between the charged and the discharged areas may, for example, be more than 200 V, more than 400 V, or more than 600 V, or in the range of 200 V to 1000 V. The charged and discharged areas may correspond to a pixel pattern of an image to be printed.

The latent image on the PIP 16, carried on the surface areas having passed the selective discharging station 20, may then be developed by transferring charged particles onto the PIP 16. In the case of DAD, the charged particles may adhere to the discharged areas of the PIP 16 while being repelled from the charged areas of the PIP 16. In the case of CAD, the charged particles may adhere to the charged areas of PIP 16 while being repelled from the discharged areas of the PIP 16. In either case, a pattern of charged particles in a layer of uniform particle concentration may be selectively formed on areas on a surface of the PIP 16. The residual charge may then be removed from the PIP 16. E.g., by exposing the PIP 16 to light of an LED lamp or another discharging device 22.

The formed layer may then be transferred to the ITM 24. As shown in FIG. 1, the ITM 24 may, for example, comprise a chargeable blanket wrapped around a rotating drum. The blanket may be heated to fuse charged particles adhering to the ITM 24. The resulting layer of fused particles may be transferred from the ITM 24 to a print medium 26. The print medium 26, which may be paper, foil, or any other medium, may be delivered to the system 10 as a continuous web, e.g., dispensed from a roll, or as individual sheets and pass through a nip between the ITM 24 and a pressure roller 28. The pressure roller 28, which is also referred to as an impression cylinder (IMP), may press the print medium 26 in the nip against the layer on the ITM 24 surface such that the layer may be cooled down and adhere to the print medium 26.

After transferring the layer onto the ITM 24, ink particle residue may be removed from surface areas of the PIP 16 which pass by a cleaning station 30. For example, the cleaning station 30 may comprise a cleaning roller and a wiper blade. After passing the cleaning station 30, a uniform electrostatic charge may be re-applied to the PIP 16 area passing the charging station 18 to start a new cycle. In each cycle, a process color may be printed by transferring charged particles of the respective color onto the PIP 16. If an image is printed by printing more than a single process color, multiple color layers may be transferred one after the other to the ITM 24. The ITM 24 may collect the color layers and transfer the full image onto the print medium 26, or the color layers may be transferred one after the other onto the print medium 26. In the first case, the pressure roller 28 may become active after the color layers are collected on the ITM 24, as indicated by the vertical arrow in FIG. 1.

Figure 2:
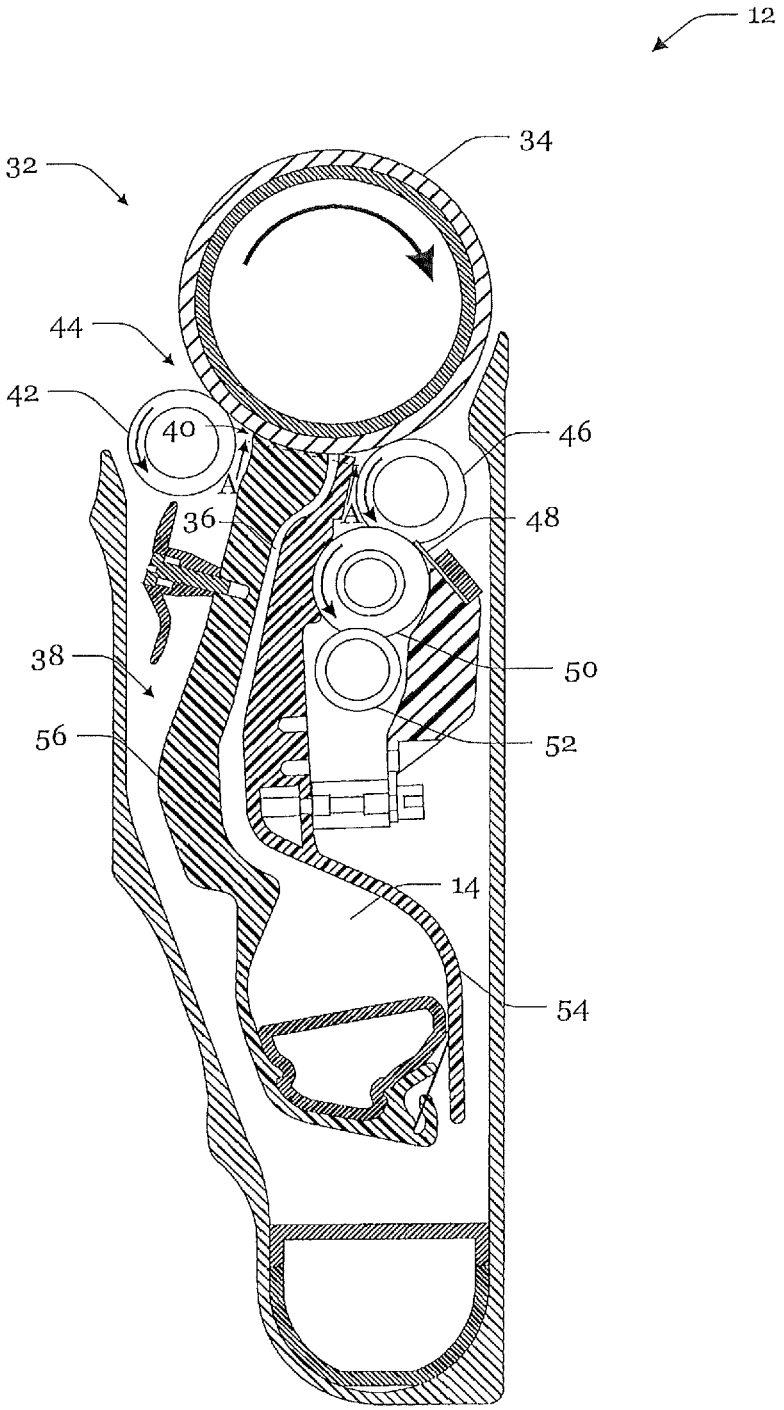
FIG. 2 is a schematic cross-sectional view of a binary ink developer, BID, assembly, according to an example.

FIG. 2 is a schematic cross-sectional view of an BID assembly 12, according to an example. The BID assembly 12 comprises a transfer device 32, which when driven during operation, may transfer an ink composition from the ink inlet 14 onto the PIP 16. The BID assembly 12 may comprise an electrode arrangement 38, forming an ink supply path 36 between a main electrode 56 and a back electrode 54 of the electrode arrangement 38. The transfer device 32 may comprise a developer roller 34 which, during operation, may receive the charged particles from the ink inlet 14 via the ink supply path 36. The ink composition may include particles and may contain a charge director which is attached to the particles so that they may react to an electrostatic field. When passing the ink composition between the electrode arrangement 38 and to the developer roller 34, if a sufficient potential is applied between the electrode arrangement 32 and the developer roller 34, the ink particles are charged and adhere to the developer roller 34. In order to form a dense particle layer on the developer roller 34, the BID assembly 12 includes the electrode arrangement 38 which generates an electric field attracting the charged particles to the surface of the developer roller 34. Ink from the ink supply path 36 passes through a gap or channel 40 between the electrode arrangement 38 and the developer roller 34. The gap or channel 40 may have a width perpendicular to a flow direction of the ink, in an axial direction of the developer roller, wherein the width may span a nominal printing width of the system 10 and substantially correspond to the width of the developer roller 34 (in the direction of its rotational axis).

As the electrode arrangement 38 and hence ink particles passing the electrode arrangement 38 may be charged to a different voltage than the developer roller 34, an electric field may be generated which is directed in a radial direction towards the developer roller 32, and which attracts the charged particles to the surface of the developer roller 34 and increases the particle density in an ink layer on the surface of the developer roller. Furthermore, the BID assembly 12 may comprise a squeegee roller 42. The squeegee roller 42 may exert mechanical and electrostatic forces onto the charged particles adhering to the surface of the developer roller 34 when urging the charged particles through the nip 44 formed between the squeegee roller 42 and the developer roller 34. Accordingly, the squeegee roller 42 may be charged to a different voltage than the developer roller 34 to increase a density of the charged particles layer on the developer roller 34 by exerting also electrostatic forces.

After transferring charged particles from the charged particles layer onto the surface of the PIP 16, the remaining charged particles may be removed from the developer roller 34. For example, FIG. 2 shows an example where a cleaner roller 46, which may be electrically charged, removes the remaining charged particles from the developer roller 34. A wiper blade 48 and a sponge roller 50 may be used to remove the charged particles from the cleaner roller 46 and remix the removed charged particles with carrier liquid fed from the ink supply path 36. For instance, a squeezer roller 52 may apply pressure to portions of a surface of the sponge roller 52 to squeeze the particles dispersed in the carrier liquid out of the pores of the sponge. A direct re-inflow of the removed particles dispersed in the carrier liquid may be prevented by an electrode member 54 of the electrode arrangement 38.

Figure 3:
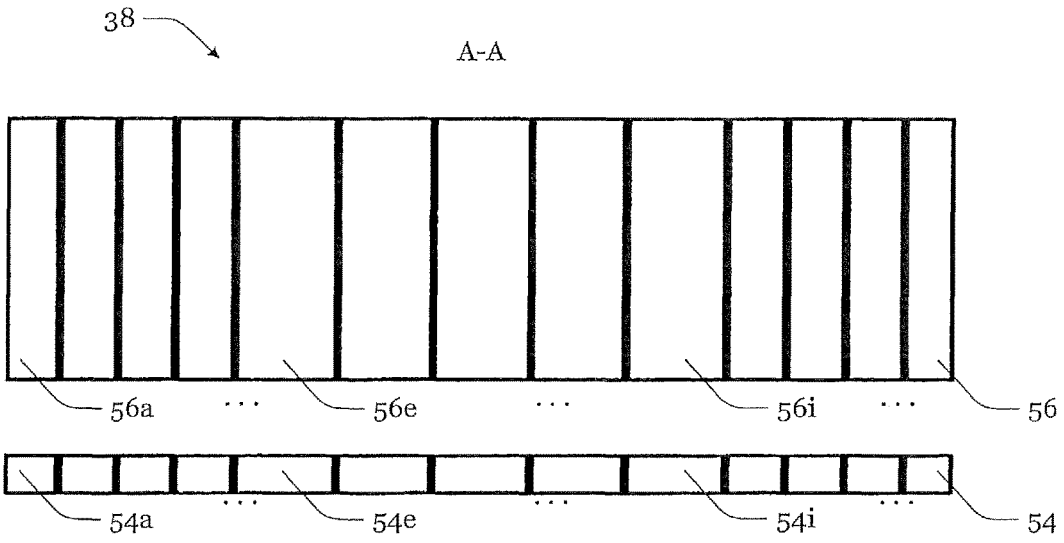
FIG. 3 is a schematic longitudinal section view of an electrode arrangement, along A-A in FIG. 2, according to an example.

FIG. 3 is a schematic longitudinal sectional view through the electrode arrangement 38 in FIG. 2, according to an example, showing the main electrode 56 and the back electrode 54. Both of the main electrode 56 and the back electrode 54 may comprise a number of ink charging electrodes segments 54*a*-54*m* and 56*a*-56*m* which respectively are arranged adjacent to each other along a direction parallel to the width direction of the gap or channel 40 (perpendicular to the drawing plane) and which are electrically insulated from each other. The insulation of the electrode segments allows individually controlling an electric potential of each electrode segments 54*a*-54*m* and 56*a*-56*m*. As shown in FIG. 3, the electrode segments 54*a*-54*m* and 56*a*-56*m* may have different widths (in a direction parallel to the width direction of the gap or channel 40), although electrode segments 54*a*-54*m* and 56*a*-56*m* of a substantially same width may also be used in another example. Opposite electrodes segments of the two electrodes 54, 56, such as segments 54*a*, 56*a*, segments 54*b*, 56*bB*, etc., will be charged to identical voltage levels to prevent cross-sectional electrostatic fields.

Figure 4:
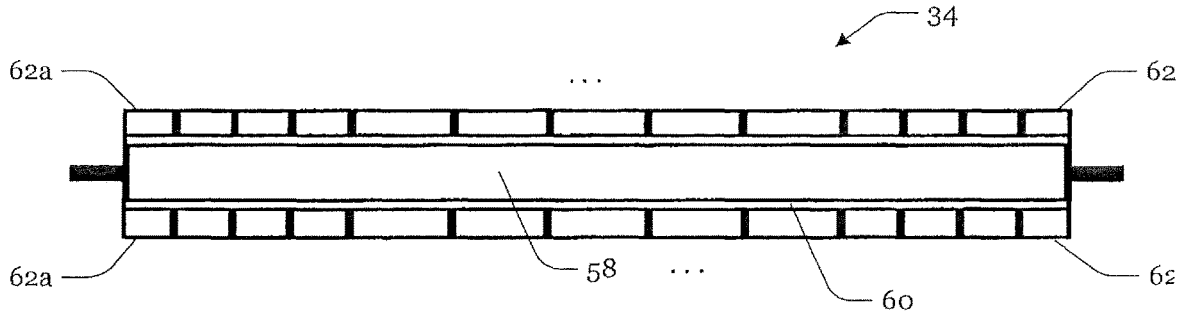
FIG. 4 is a schematic longitudinal section view of a developer roller, according to an example.

FIG. 4 is a schematic longitudinal sectional view of a developer roller 34, according to an example. The developer roller 34 may comprise a hollow cylindrical core 58. The core 58 may be manufactured from any suitable material, such as, e.g., metal, plastic and the like. In case of a conductive core 58, the core 58 may further be provided with an insulating layer 60. The developer roller 34 may also include a shaft and gear arrangement connected to the core 58, which may be operatively associated with a drive assembly (not shown) of the system 10. The drive assembly may include mating gears to effect rotational movement of the developer roller 34 during a printing operation in which the PIP 16 is rotated to have the same surface speed direction in the nip as the developer roller 34, at the same or at a different speed. For example, there may be a small surface speed difference between the PIP and the developer roller.

A plurality of conductive developer roller segments 62*a*-62*m* may be arranged on the periphery of the developer roller 34. If the developer roller 34 includes a conductive core, an insulating layer 60 will be provided between the core and the conductive developer roller segments 62*a*-62*m*. Alternatively, the core 58 can be made of a non-conducting material. The conductive developer roller segments 62*a*-62*m* may be ring segments or partial ring segments of a conductive and electrically chargeable material, for example. For instance, the developer roller segments 62*a*-62*m* may be made of a conductive material, e.g., metal such as, for example, aluminum, stainless steel, and combinations thereof, or may be made of polymeric material incorporating additives such as metal particles, ionic charged particles, carbon black, graphite, etc., and combinations thereof.

Moreover, flexible conductors may be used for connecting the developer roller segments 62*a*-62*m* to a power source and control circuit (not shown). The developer roller segments 62*a*-62*m* are electrically isolated from each other.

Gaps between the developer roller segments 62*a*-62*m* (in the width direction) may be filled with spacer rings made from an insulating material. The gaps may be small enough, e.g., below 3 mm or below 1 mm, e.g. between 0.1 mm and 1 mm, to avoid large field variations and/or an electric field breakdown between the developer roller segments 62*a*-62*m*. The developer roller segments 62*a*-62*m* may be covered with a layer made from an insulating material. The insulating material may be any kind of suitable material, with polyurethane being one possible option. As shown in FIG. 4, the developer roller segments 62*a*-62*m* may have different widths (in a direction parallel to the width direction of the gap or channel 40), although developer roller segments 62*a*-62*m* of substantially a same width may also be used in another example. Moreover, the widths of the developer roller segments 62*a*-62*m* may correspond to or match with the widths of the electrode segments 54*a*-54*m* and 56*a*-56*m*, as can be recognized from comparing FIG. 3 and FIG. 4, although the drawings are not necessarily drawn to scale.

Furthermore, whereas electrodes segments 54*a*-54*m* and 56*a*-56*m* and developer roller segments 62*a*-62*m* can be provided to correspond to each other in a single system 10, the disclosure is not intended to be limited to such a configuration. Rather, the system 10 may comprise the electrode arrangement 38 of FIG. 3 in combination with a developer roller 34 having a continuous surface layer, or the system 10 may comprise an electrode arrangement 38 having a single electrode pair 54, 56, in combination with a segmented developer roller 34 as shown in FIG. 4. In a configuration where a segmented electrode pair 54, 56 and a segmented developer roller 34 are used, respective segments are aligned to each other to avoid undefined cross-sectional fields.

Figure 5:
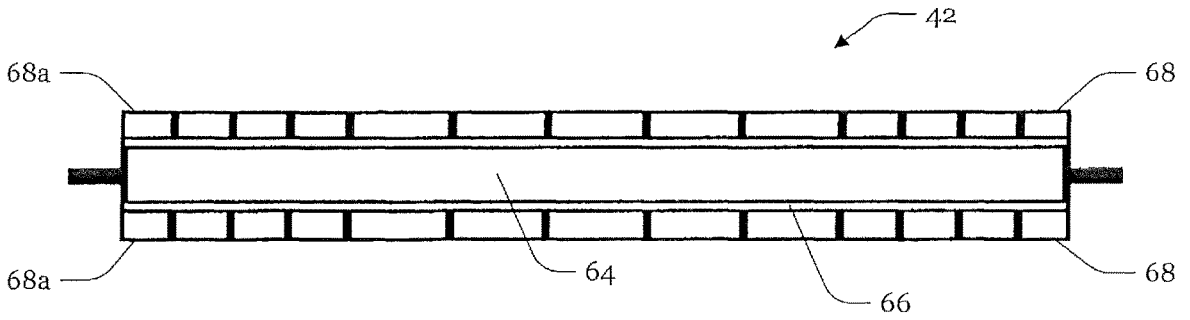
FIG. 5 is a schematic longitudinal section view of a squeegee roller, according to an example.

FIG. 5 is a schematic longitudinal section view of a squeegee roller 42, according to an example. The squeegee roller 42 may comprise a hollow cylindrical core 64. The core 64 may be manufactured from a material which matches to the material of the developer roller 34 core 58. In case of a conductive core 58, the core 58 may further be provided with an insulating layer 66. The squeegee roller 42 may also include a shaft and gear arrangement connected to the core 64, which may be operatively associated with the drive assembly (not shown) of the system 10. The drive assembly may include mating gears to effect rotational movement of the squeegee roller 42 during a printing operation in which the squeegee roller 42 is rotated to have the same surface speed direction in the nip as the developer roller 34, at the same or at a different speed. For example, there may be a small surface speed difference between the squeegee roller 42 and the developer roller 32.

On the insulating layer 66, or on a core 64 made of a non-conducting material, a plurality of squeegee roller segments 68*a*-68*m*, such as ring segments or partial ring segments, may be arranged. For instance, the squeegee roller segments 68*a*-68*m* may be made of a conducting and electrically chargeable material, e.g., metal such as, for example, aluminum, stainless steel, and combinations thereof. The squeegee roller segments 68*a*-68*m* may also comprise a core of non-conducting material coated or covered with a layer of a conductive material layer, e.g., a layer of polymeric material incorporating additives such as metal particles, ionic charged particles, carbon black, graphite, etc., and combinations thereof. Moreover, flexible PCBs may be used for wiring.

Gaps between the squeegee roller segments 68*a*-68*m* (in the width direction) may be filled with spacer rings made from an insulating material. The gaps may be small enough, e.g., below 3 mm or below 1 mm, e.g. between 0.1 mm and 1 mm, to avoid large field variations and/or an electric field breakdown between the squeegee roller segments 68*a*-68*m*. As shown in FIG. 5, the squeegee roller segments 68*a*-68*m* may have different widths (in a direction parallel to a direction of rotation of the squeegee roller 42) although squeegee roller segments 68*a*-68*m* of substantially a same width may also be used. Moreover, the widths of the squeegee roller segments 68*a*-68*m* correspond or match to the widths of the electrode segments 54*a*-54*m* and 56*a*-56*m* as can be seen from FIG. 3 and FIG. 5 and/or correspond or match to the widths of the developer roller segments 62*a*-62*m* as can be seen from FIG. 4 and FIG. 5.

As indicated above, it is possible to have corresponding electrode segments 54*a*-54*m* and 56*a*-56*m*, developer roller segments 62*a*-62*m*, and squeegee roller segments 68*a*-68*m* in a single system 10, but the disclosure is not limited to such a configuration. Rather, the system 10 may comprise a segmented squeegee roller 42, as in FIG. 5, alone, or in combination with either one or both of the segmented electrode arrangement 38 of FIG. 3 and the segmented developer roller 34 of FIG. 4.

Figure 6:
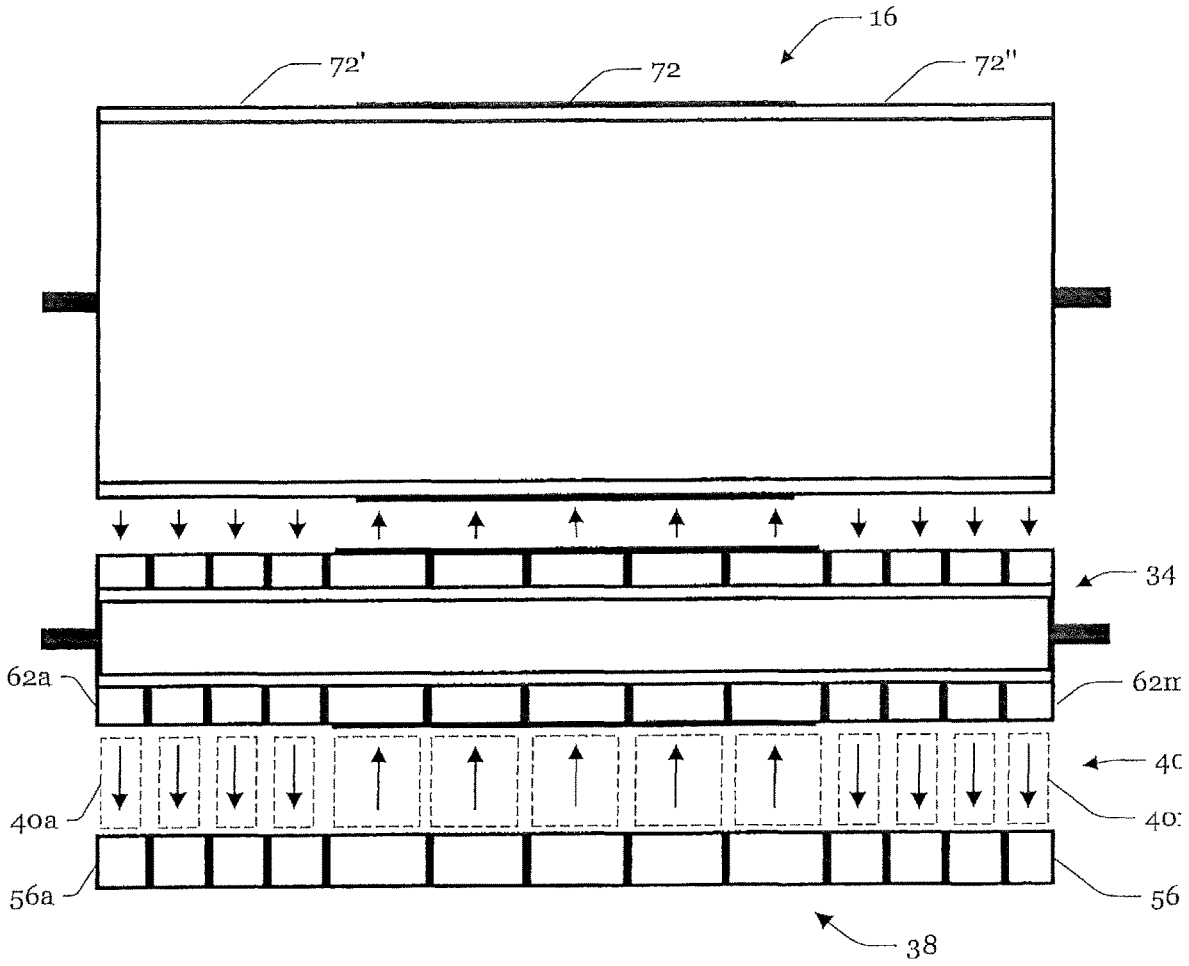
FIG. 6 is a schematic longitudinal section view of the electrode arrangement of FIG. 3 and the developer roller of FIG. 4 during a process involving transferring charged particles to the PIP, according to an example.

FIG. 6 is a schematic longitudinal sectional view of the electrode arrangement of FIG. 3 and the developer roller of FIG. 4 used in a process involving transferring charged particles to the PIP 16. Rather than having a uniform electric field in the gap or channel 40 between the electrode arrangement 38 and the developer roller 34, along the width of the developer roller 34 or over the entire (nominal) printing width (which may correspond to around the width of the PIP 16), the electric field may be individually controllable (in the width direction) on the basis of segments 40*a*-40*m* along the width of the a gap or channel 40 (as indicated by the arrows which are framed by broken lines which schematically illustrate the segments 40*a*-40*m*).

In a basic configuration, the system 10 may thus comprise the transfer device 32 to transfer charged particles from a surface of the transfer device 32 onto the PIP 16. The system further may comprise an ink supply path 36 to feed the charged particles suspended in a non-conductive fluid to the transfer device 32, and an electrode arrangement 38 to generate an electric field attracting or repelling charged particles to/from the surface of the transfer device 32, wherein the surface of the transfer device 32 is dividable into segments, and attracting or repelling charged particles to/from the segments is individually controllable.

For instance, to individually control a particle concentration or density of a charged particles layer on developer roller segments 62*a*-62*m* along a direction parallel to an axis of rotation of the developer roller 34, corresponding electrode segments of the BID and segments of the developer roller and/or corresponding segments of the developer roller and segments of the squeegee roller may be charged to different voltage levels. Corresponding segments of the electrodes, the developer roller and/or the squeegee roller may be located opposite to each other. For example, one of the pairs of ink charging electrode segments 56*a*-56*m*, 54*a*-54*m* of the electrode arrangement 38 and a corresponding one of the developer roller segments 62*a*-62*m* of the developer roller 34, and/or one of the developer roller segments 62*a*-62*m* and a corresponding one of the squeegee roller segments 68*a*-68*m* may be aligned and located opposite to each other. Thus, charged particles may be repelled from some surface segments of the developer roller 34 while being attracted or drawn to other surface segments of the developer roller 34.

In an example, a lower voltage in a range of 300 V to 600 V may be applied to a first group of electrode segment pairs, such as electrode segment pairs 54*a*-54*d*/54*j*-54*m*, 56*a*-56*d*/56*j*-56*m*, whereas a higher voltage in a range of 1000 V to 1500 V may be applied to a second group of electrode segment pairs, such as electrode segment pairs 54*e*-54*i*, 56*e*-56*i*. Moreover; a higher voltage in a range of 600 V to 1000 V may be applied to a first group of developer roller segments, such as segments 62*a*-62*d* and 62*j*-62*m*, whereas a lower voltage in a range of 300 V to 600 V may be applied to a second group of developer roller segments, such as segments 62*e*-62*i*. The PIP 16 may be uniformly charged to 1000 V and then selectively discharged according to a pattern of pixels to be printed, wherein discharged areas may be at about zero (0) V or may be charged up to 100 V. Thus, a charged particle in the gap or channel 40 would be drawn to the developer roller segments 62*e*-62*i* and then to a discharged area of the PIP 16. If a non-segmented squeegee roller 42 is used, a uniform voltage in a range of 800 V to 1100 V may be applied to the squeegee roller 42. If a segmented squeegee roller 42 is used, a first group of squeegee roller segments, such as segments 68*a*-68*d* and 68*j*-68*m* may be charged at a reduced voltage in a range of 300 V to 600 V, and the remaining segments, such as segments 68*e*-68*i*, may be charged at the higher voltage of 800 V to 1100 V. In the above example, the first group of electrode pairs/segments is charged to provide a non-developing area of the developer roller, and the second group of electrode pairs/segments is charged to provide a developing area of the developer roller.

This allows controlling a width of a charged particles layer of uniform density on the surface of the developer roller 34, wherein the charged particles layer can have a reduced width when compared to having a charged particles layer of uniform density extending over the entire width of the developer roller 34. It is hence possible to generate a charged particles layer of reduced width in developer roller segments 62*e*-62*i*, when compared to the entire width of the developer roller 34.

For example, if areas 72', 72" of the PIP 16 are not actively involved in the printing process, a charged particle density may be reduced in corresponding developer roller surface segments 62*a*-62*d* and 62*j*-62*m* of the developer roller 34, which otherwise might unintentionally pressure-force charged particles onto the PIP 16. It is also possible to generate multiple spaced charged particles layers across the segments. A similar effect can be achieved, or the effect of selectively charging the electrode segments 54*a*-54, 56*a*-56*m* and developer roller segments 62*a*-62*m* can be enhanced by analogously controlling the voltage levels of the squeegee roller segments 68*a*-68*m* of the squeegee roller 42. The squeegee roller 42 may account for about 30% of the density increase of the ink particles in the imaging oil.

Figure 7:
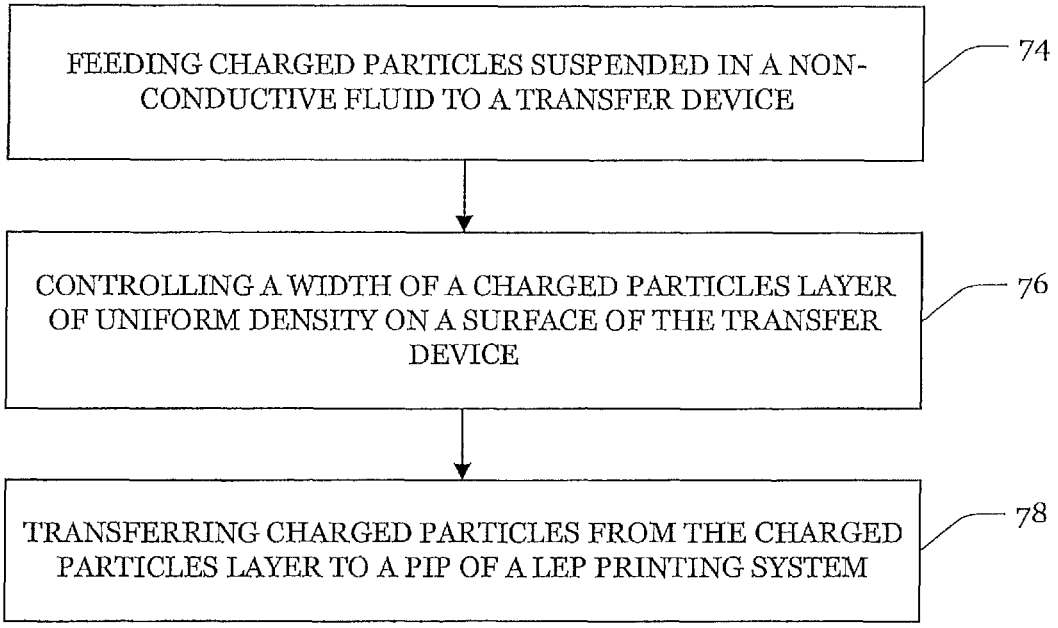
FIG. 7 is a flow-chart of a process of controlling a width of a charged particles layer of uniform density on a surface of the transfer device, according to an example.

A flow-chart of a process according to an example is shown in FIG. 7. The process, at 74, feeds ink containing charged particles suspended in a non-conductive fluid to the transfer device 32. At 76, the process comprises controlling a width of a charged particles layer of uniform density on a surface of the transfer device 32 such as, for example, by controlling a width of a charged particles layer of uniform density on a surface of the developer roller 34 as described above. At 78, the process further includes transferring charged particles from the charged particles layer to the PIP 16.

Figure 8:
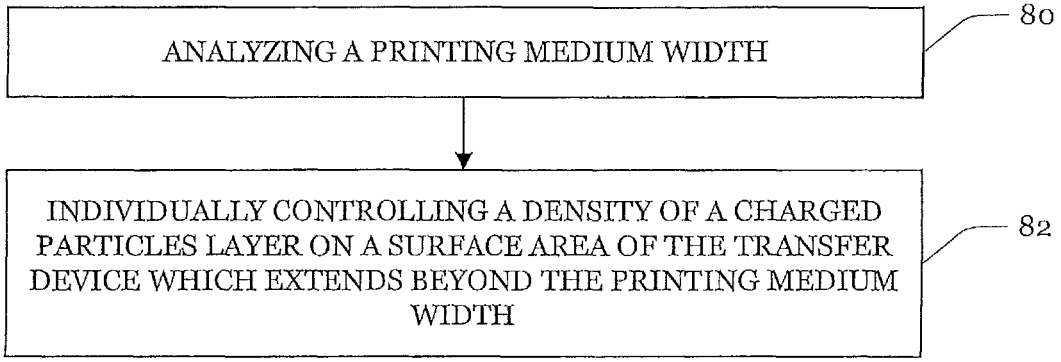
FIG. 8 is a flow-chart of another process of controlling a width of a charged particles layer of uniform density on a surface of the transfer device, according to an example.

FIG. 8 is a flow-chart of a process of controlling a width of a charged particles layer of uniform density on a surface of the transfer device 32, according to an example. For instance, the width of the transfer device 32 (which may correspond to about the nominal printing width of the system 10) may be broken-down in (width) segments and some width segments may be activated selectively during a printing job, wherein the selective activation may correspond to a width of the printing medium 26 on which the image is to be transferred. Segments outside an actual printing width may be disabled by reversing the electric field in the corresponding gap or channel segments 40*a*-40*m*.

The activated segments, which also may be referred to as developing segments, may draw charged particles to the surface of the transfer device 32 whereas the deactivated segments, which also may be referred to as non-developing segments, may draw charged particles to the surface of the transfer device 32 with less force, not draw charged particles to the surface of the transfer device 32, or even repel charged particles from the surface of the transfer device 32. In this regard, it is to be noted that no substantial electric current flow may be needed to keep width segments activated (or deactivated).

Developing segments and non-developing segments of the developer roller 34 are established by applying selected voltage differentials between the respective segments of the electrode segments 54*x*, 56*x* (x designating a respective segment number) and the developer roller segments 62*x*, and voltage differentials between the respective squeegee roller segments 68*x* and the developer roller segments 62*x*. Absolute voltages and the amount of voltage differentials depend on print system configuration, such as calibration voltages useful for performing color calibration, for example. The following values hence are examples of useful voltages for generating developing segments and non-developing segments in one printing system but values may be different for another printing system.

In one example, in a developing area of the developer roller 34, the following voltages may be applied: an electrode segment pair 54*x*, 56*x* is charged at about 1000 V; a developer roller segment 62*x* is charged at about 500 to 550 V; a squeegee roller segment 68*x* is charged at about 900 V; and the PIP surface, in a pixel area where an image is to be printed, is charged close to zero or up to 60 V. In a non-developing area of the developer roller 34, the following voltages may be applied: an electrode segment pair 54*x*, 56*x* is charged at about 400 V; a developer roller segment 62*x* is charged at about 800 V; a squeegee roller segment 68*x* is charged at about 400 V; and the PIP surface is charged at about 1000 V.

Figure 9:
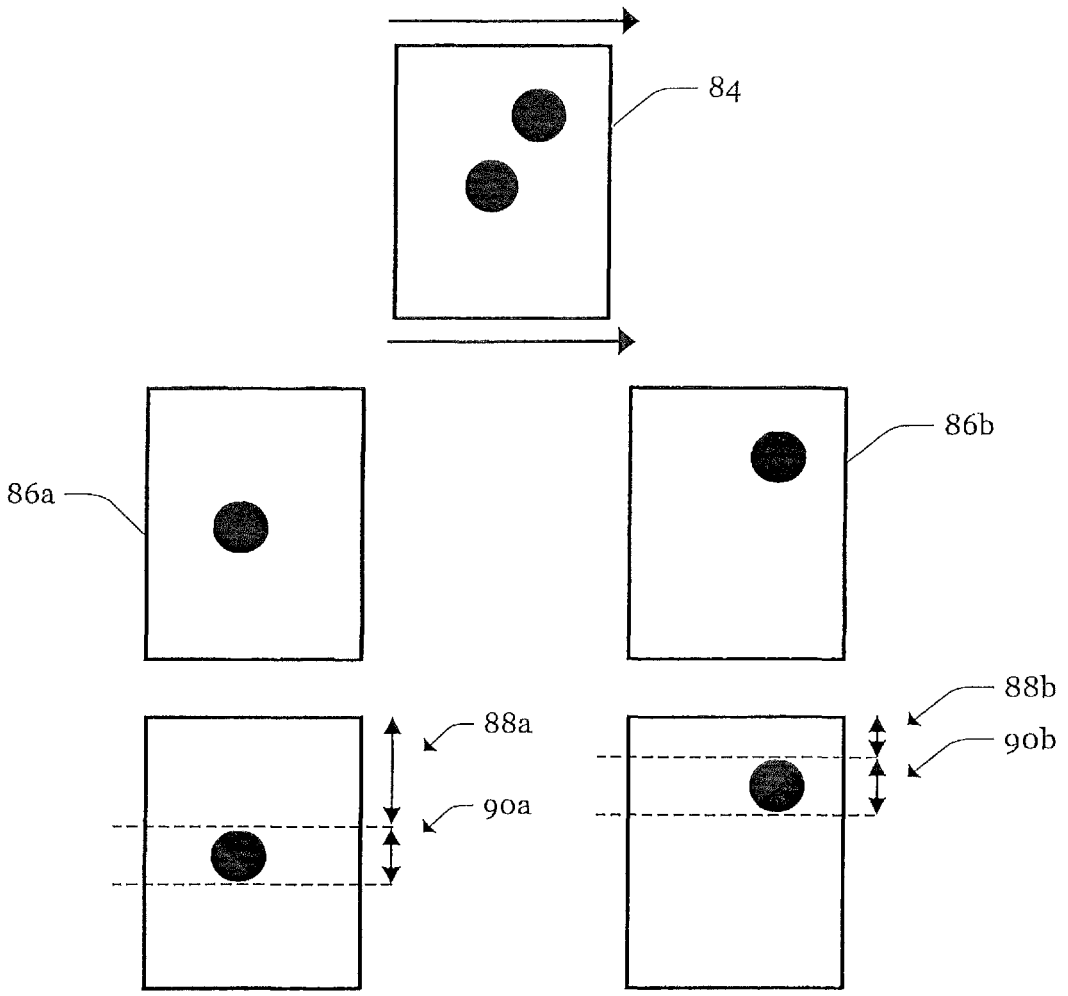
FIG. 9 illustrates a process of analyzing a width and position of color layers of an image to be printed, according to an example.
Figure 10:
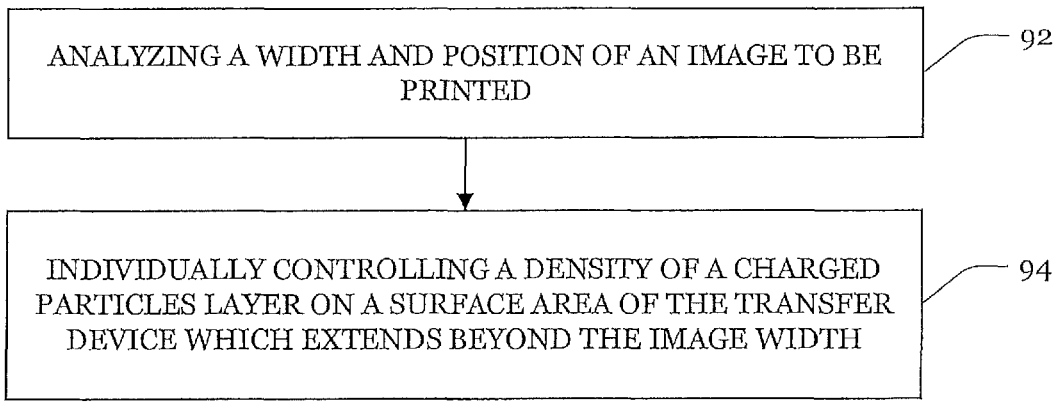
FIG. 10 is a flow-chart of a process of controlling a density of a charged particles layer on a surface area of the transfer device, according to an example.
Figure 11:
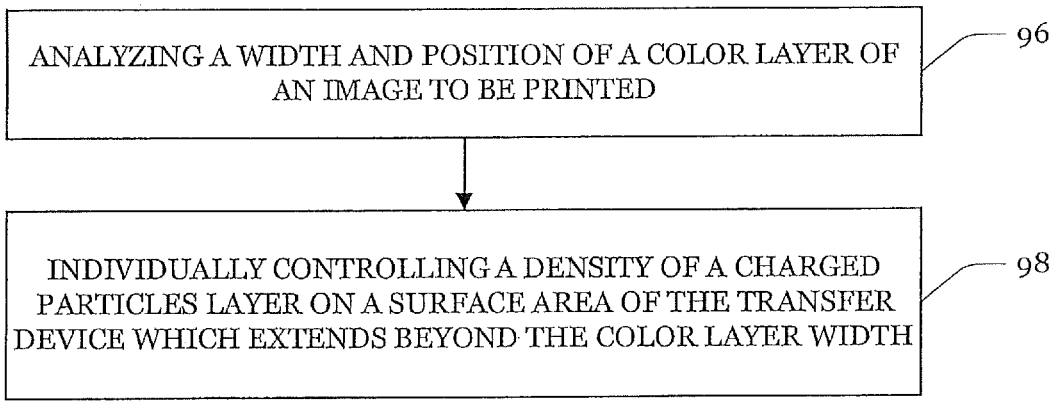
FIG. 11 is a flow-chart of another process of controlling a density of a charged particles layer on a surface area of the transfer device, according to an example.

As shown in FIG. 9, said principle may be extended on an image or color-layer basis, by disabling segments (in a direction of printing width direction) that are not needed for printing a particular image 84 or color layer 86*a*, 86*b*. FIG. 9 shows an example of an image 84 which may be divided into color layers 86*a*, 86*b*. A direction of the media advance, i.e. the direction in which a print medium for receiving the image is fed through the printer, is indicated by arrows along two sides of image 84. The printing width direction is perpendicular to these arrows. A position 88*a*, 88*b* and a width 90*a*, 90*b* of elements that are to be printed may be determined. Arrows 88*a* and 80*b* indicate distances of two different color elements from a print medium edge, and arrows 90*a* and 90*b* indicate the respective widths of the two color elements. Based on the determined positions 88*a*, 88*b* and widths 90*a*, 90*b*, segments that are needed may be enabled and segments that are not needed may be disabled as indicated in the flow charts of FIGS. 10 and 11.

Hence, instead of providing for a uniform ink layer on the entire developer roller 34 with the risk of transferring some of the ink between the developer roller 34 and the PIP 16, in areas, where no image should be created, e.g., by mechanical pressure, ink on the developer roller 34 may be developed in areas where the ink is needed and may not be developed in areas where ink is not needed, by providing different electrical fields in different segments along the width of the developer roller 34. This may be particularly noticeable when using printing media 26 of different widths where ink should not be transferred from the developer roller 34 to the PIP 16 outside of the print medium margins. This also may be useful when printing small width images, as shown in FIG. 9. Ink hence is transferred in a width segment where it is needed and not transferred in a width segment where it is not needed. Otherwise, ink may accumulate on the edges of the PIP 16 and decrease print-quality. Moreover, the ink and other consumables may be wasted and the wear of the BID assembly 12 may be increased.

This may be avoided by using a BID assembly 12 which comprises a developer roller 34 to receive charged particles and a device to generate an electric field attracting or repelling charged particles to/from the developer roller surface, wherein the device enables individually controlling a concentration of a charged particles layer on developer roller surface segments along a direction parallel to an axis of rotation of the developer roller.

For example, if the two electrodes 54, 56 of the electrode arrangement 38 and hence the particles of the ink are charged at a negative electric potential when compared to the electric potential of the developer roller, a positive voltage difference may be established between the developer roller 34 and the electrode arrangement 38 in an ink-transfer-segment to draw ink to the developer roller 34. In a no-ink-transfer segment, a negative voltage difference or equal voltages may be established between the developer roller 34 and the electrode arrangement 38. Analogously, if the ink comprises positively charged particles, a negative voltage difference may be established between the developer roller 34 and the electrode arrangement 38 in an ink-transfer-segment. In a no-ink-transfer segment, a positive voltage difference or equal voltages may be established between the developer roller 34 and the electrode arrangement 38.

As described above, this may be realized by segmenting the electrode arrangement 38 and/or the developer roller 34 and/or the squeegee roller 42 and applying different voltages to the respective segments or by taking on any other means which allows individually controlling attracting or repelling charged particles from the segments.

The invention claimed is:

1. A binary ink developer for a liquid electro-photographic printing system, comprising:

a developer roller to transfer charged particles in an ink from a surface of the developer roller onto a photo imaging plate, the developer roller having multiple conductive segments each individually controllable to attract or repel charged particles to/from the surface of the developer roller;

an ink supply path along which the ink is fed toward the surface of the developer roller; and an electrode having multiple conductive segments each located opposite a corresponding one or more of the roller segments and each individually controllable to generate an electric field attracting or repelling charged particles in the ink to/from the surface of the developer roller.

2. The binary ink developer of claim 1, wherein the electrode comprises:

a first electrode having multiple, individually controllable conductive first segments; and a second electrode having multiple, individually controllable conductive second segments each located opposite a corresponding one or more of the first segments.

3. A binary ink developer for a liquid electro-photographic printing system, comprising:

a transfer device to transfer charged particles from a surface of the transfer device onto a photo imaging plate;

an ink supply path to feed the charged particles suspended in a non-conductive fluid to the transfer device;

an electrode arrangement to generate an electric field attracting or repelling charged particles to/from the surface of the transfer device;

wherein the surface of the transfer device is dividable into segments, and attracting or repelling charged particles to/from the segments is individually controllable; and a squeegee roller with a plurality of segments made of conductive material, the segments being arranged along a direction parallel to an axis of rotation of the squeegee roller, wherein the segments are electrically insulated from each other.

4. A binary ink developer assembly usable with a printing system, comprising:

a developer roller having a surface to receive charged particles from an ink reservoir and transfer charged particles to a photo imaging plate; and a device to generate an electric field attracting or repelling charged particles to/from the developer roller surface, the device including an electrode opposite the developer roller surface with multiple conductive segments each individually controllable to generate multiple different electric fields along a width of the developer roller surface to attract or repel charged particles to/from the developer roller surface.

5. The binary ink developer assembly of claim 4, wherein the electrode comprises:

a first electrode having multiple, individually controllable conductive first segments; and a second electrode having multiple, individually controllable conductive second segments each located opposite a corresponding one or more of the first segments.

6. The binary ink developer assembly of claim 5, wherein the developer roller includes multiple conductive segments each located opposite a corresponding one or more of the electrode segments and each individually controllable to attract or repel charged particles to/from the developer roller surface.

7. The binary ink developer assembly of claim 6, comprising a squeegee roller located opposite the developer roller downstream from the electrodes in a direction of rotation of the developer roller, the squeegee roller having multiple conductive segments each located opposite a corresponding one or more of the developer roller segments and each individually controllable to control a concentration of charged particles on the developer roller surface.

* * * * *